US006925278B2

(12) United States Patent
Boness et al.

(10) Patent No.: US 6,925,278 B2
(45) Date of Patent: Aug. 2, 2005

(54) PROCESS AND CONTROL MECHANISM FOR AVOIDING REGISTER ERRORS

(75) Inventors: Jan Dirk Boness, Bad Bramstedt (DE); Ingo Klaus Michael Dreher, Kiel (DE); Heiko Hunold, Wattenbek (DE); Stefan Schrader, Kiel (DE)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 10/826,701

(22) Filed: Apr. 16, 2004

(65) Prior Publication Data

US 2004/0226470 A1 Nov. 18, 2004

(30) Foreign Application Priority Data

Apr. 25, 2003 (DE) ..... 103 18 997

(51) Int. Cl.[7] ..... G03G 15/16

(52) U.S. Cl. ..... 399/301; 101/483; 101/485; 399/165; 399/303; 400/635

(58) Field of Search ..... 399/165, 301, 399/303

(56) References Cited

U.S. PATENT DOCUMENTS 5,101,232 A * 3/1992 Evans et al. ..... 399/160
6,336,019 B2 * 1/2002 Castelli et al. ..... 399/162
2004/0009019 A1 * 1/2004 Hosokawa ..... 399/301

FOREIGN PATENT DOCUMENTS

JP 11288198 * 10/1999 ..... G03G/21/00

* cited by examiner

*Primary Examiner*—Arthur T. Grimlay
*Assistant Examiner*—Peter Lee
(74) *Attorney, Agent, or Firm*—Lawrence P. Kessler

(57) ABSTRACT

Ensuring proper compass and register positioning during printing. Marks are imprinted on a carrying element and at least one sensor is present to detect the marks on the carrying element and a second sensor detects a seam on the carrying element. A control mechanism receives mark values from the first sensor and seam values from the second sensor, and discarding mark values when the seam is detected.

8 Claims, 3 Drawing Sheets

PROCESS AND CONTROL MECHANISM FOR AVOIDING REGISTER ERRORS

FIELD OF THE INVENTION

The invention relates in general to avoiding register errors in the process and control of a printing mechanism.

BACKGROUND OF THE INVENTION

In the printing industry, various processes are used to avoid and correct compass and register errors. Compass or register errors occur when an image is imprinted at an incorrect location on a printing image carrying element or on a printing medium. The term "in compass" or "in register" identifies a condition in which the printed image is imprinted at the correct location on a printing medium, i.e., the image is imprinted at the proper level or in the proper position. In multi-color printing, the term "compass" is standardly used, while in mono-color printing, the term "register" is used. To avoid compass and/or register errors, register marks or marks that are imprinted on a carrying element of the printing machine or on the printing medium, are often used in order to check the printing medium's register or compass; i.e., whether the compass or register is free of error. In the foregoing, the term "mark" will be used exclusively to describe both terms (compass and register).

The carrying element is often the conveyor belt that carries the printing medium or, in the case of electrophotographic printing, the master cylinder that carries the printed image. Marks come in various shapes, sizes, and colors. Outside of the printing machine, marks are manually measured by an operator with the aid of a magnifying lens and measuring mechanisms. Inside the printing machine marks are automatically measured with the aid of sensors, whereby any shifting of the printed image will be identified. Identification of a compass and/or register error is accomplished either before imprintation, as a means of calibrating the printing machine, or during the imprintation, i.e., on the fly.

The quality of the correct positioning of the compass and/or register is a significant factor for the quality of the printing result. With increasingly higher demands for quality printing and for proper positioning of the imprinted image, attempts are made to adjust the register with even greater precision.

SUMMARY OF THE INVENTION

In view of the above, this invention is directed to ensuring proper compass and register positioning during printing. The invention avoids compass and register errors in a printing machine, whereby marks are imprinted on a carrying element and at least one sensor detects the marks on the carrying element and a second sensor detects a seam on the carrying element. Beneficially, the sensor values read by the first sensor in the area of the seam that is detected by the second sensor are discarded in a control mechanism. Sensor values that are influenced by the seam lead to false corrections and their use is avoided by discarding them.

In one embodiment of the invention, the area in which the sensor values of the first sensor are discarded is 18.5 mm long upstream of the seam and 18.5 mm long downstream of the seam in relation to the carrying element's direction of conveyance compass and register errors are specifically avoided when the area in which sensor values of the first sensor are discarded is 12.8 mm long upstream from the seam and 12.8 mm long downstream from the seam in relation to the carrying element's direction of conveyance. The listed areas are specified for the particular purpose of avoiding compass and register errors.

In an alternative embodiment of the invention, the sensor values read by the first sensor are examined in the control mechanism and as a result of this examination, those sensor values read by the first sensor, that come from detection of the seam by the first sensor are discarded. Therefore, the necessity for a second sensor for detecting the seam is removed.

The invention, and its objects and advantages, will become more apparent in the detailed description of the preferred embodiment presented below.

BRIEF DESCRIPTION OF THE DRAWINGS

In the detailed description of the preferred embodiment of the invention presented below, reference is made to the accompanying drawings, in which.

DETAILED DESCRIPTION OF THE INVENTION

Figure 1:
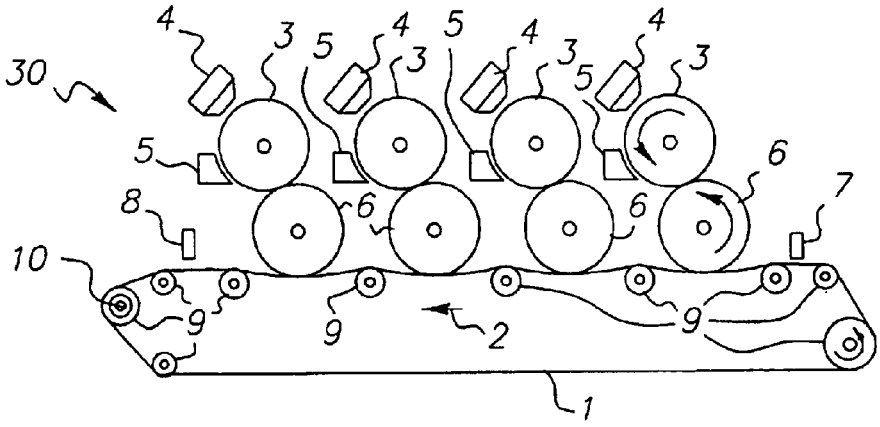
FIG. 1 shows a schematic side view of an imaging mechanism and a carrying element of an electrophotographic printing machine.

Referring now to the accompanying drawings, FIG. 1 shows an embodiment of the invention with a schematic side view of an imaging mechanism 30 and a carrying element 1, which are secured in an electrophotographic printing machine. Shown is a carrying element 1, which in this embodiment is a conveyor belt that conveys printing media through a printing machine in the direction indicated by the arrow designated by the numeral 2. The carrying element can also be, for example, a cylinder in an electrophotographic printing machine that carries images on its outer surface, such as an imaging cylinder. The carrying element 1 is stretched across several rollers and is of a closed loop configuration. In the course of manufacturing, various methods are used to join the ends of the carrying element 1, and in this example, the ends of the conveyer belt are welded together.

Figure 5:
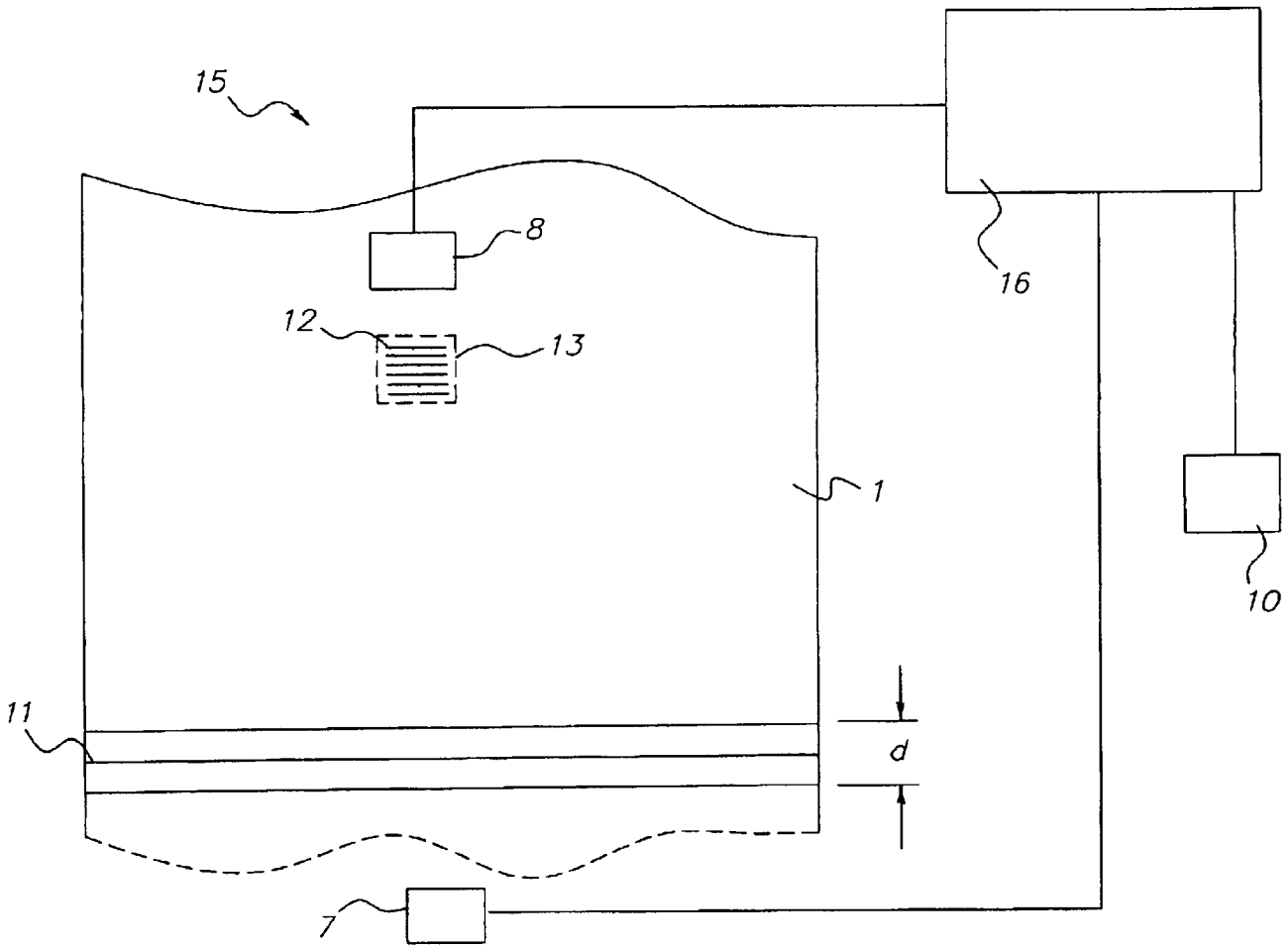
FIG. 5 shows a schematic block diagram of an embodiment of the invention to illustrate its objective.

As shown in FIG. 5, a seam 11 forms along the welded ends of the carrying element 1. Above the carrying element 1, the imaging mechanism 30 of the electrophotographic printing machine is depicted. Four printing modules or printing mechanisms are arranged in a series, each of which represents one print color, for example, cyan, magenta, yellow, and black. The print colors are impressed one over the other, after which they blend to produce a full color picture. In each printing module, electrostatically loaded images are transferred onto an imaging cylinder 3 by a print mechanism 4, which is continually supplied with toner from toner stations 5. The toner from toner stations 5 clings electrostatically to the outer surface of the imaging cylinder 3 and a visible image is formed. In this embodiment, each of the individual color images of imaging cylinder 3 is transferred to an intermediate cylinder 6 which has a rubber coating and which transfers the individual color images onto a printing medium. On the printing medium, the partial pictures blend together into a complete multi-colored picture.

A second sensor 7 is located upstream of the four print modules, above the carrying element 1, while a first sensor 8 is located above the carrying element 1, downstream of the print modules. Provision can be made for additional sensors. For the present embodiment, a calibration run is run for an electrophotographic printing machine before printing orders or jobs are executed. During calibration, marks 12 (see FIG. 5) from the four print modules are imprinted on the printing medium, such as a sheet of paper, or onto the carrying element 1, which are then detected by the first sensor 8 downstream from the print modules. Specifically, each print module imprints a colored mark onto the carrying element 1.

The first sensor 8, downstream of the print modules, is activated by the second sensor 7, upstream of the print modules after a certain number of clock pulses from the angle of rotation of the sensor/transmitter 10. Using the marks 12, a determination is made concerning how close to compass and/or register the individual colors are being imprinted. Deviations from the desired compass and/or register (i.e., from the imprintation of the marks 12 in the correct places) are measured, and subsequent corrections to the deviations are made in various ways. During the calibration run of the printing machine, the second sensor 7 sends out a signal that simulates the leading edge of a sheet of paper to a control mechanism 15 (see FIG. 5).

In order to generate a signal to simulate the leading edge of a sheet of paper, provision can alternatively be made for an additional sensor (not shown). This simulated point serves as a reference point for the marks 12, and each mark 12 is evaluated in reference to the signal from the second sensor 7. From this evaluation, corrective parameters are derived that are then used to set various parameters of the printing machine. Overall, it is desirable that the corrective parameters be identified as accurately as possible, that the compass and register be error free, and that measurement errors be avoided.

Figure 2:
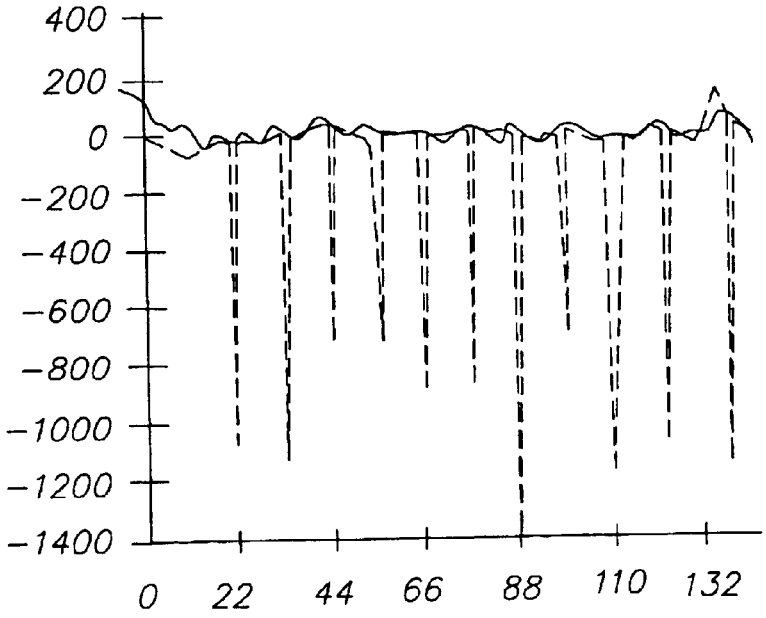
FIG. 2 shows a graph of register errors as a function of patterns of marks at four printing colors.

FIG. 2 shows a graph of the compass and/or register errors as a function of the patterns 13 (see FIG. 5) and marks 12 that are imprinted on the carrying element 1. Each pattern 13 incorporates a mark 12 for each color, such as cyan, magenta, yellow, and black. Compass and register errors are defined as shiftings of the marks 12 in the printing medium's direction of travel, the so-called "in-tracks" or "in-track errors". The compass and register error units are measured, for example, in micrometers. The imprinted patterns 13 of marks 12 are identified by numbers, whereby, each pattern number in this embodiment incorporates four marks 12, of one color each. Therefore, there is one mark 12 for each color. The four colored marks 12 are also called "patterns 13" or "patches".

In FIG. 2, the x-axis is identified by numbers that range approximately from zero up to one hundred and forty patterns 13 of marks 12. Essentially, the register errors vary around zero in a range between −150 micrometers and +150 micrometers. These are the common compass and/or register errors that are not influenced by seam 11, that are detected and corrected.

At each eleventh pattern 13 of mark 12, however, the compass and/or register errors spread out and assume substantially higher values, mainly between −700 micrometers and −1400 micrometers. This can be explained as follows: The first sensor 8 detects eleven patterns 13 of marks 12 for each rotation of the carrying element 1; after eleven measurements of patterns 13 by the first sensor 8, the carrying element has made one rotation around the rollers 9 and is back to its starting position. During the course of each rotation, however, the first sensor 8 also detects the seam 11, at which the two ends of the carrying element are welded together. The measuring signal for the patterns 13 of marks 12 at this seam 11 are obviously severely inaccurate such that the compass and/or register errors for this area at the seam 11 are unusable. The seam 11 is recognized by the first sensor either mistakenly as marks 12, or the measurement of marks 12 are so inaccurate because of the seam 11, that the impression of a large compass and/or register error incorrectly arises, i.e., an error that does not actually exist, as shown in FIG. 2. When the measured and displayed compass and/or register errors are accepted without being examined, large measurement errors are obtained that lead to incorrect provisions during the calibration, and ultimately to compass and/or register errors during subsequent printing operations. The above-described inaccurate measurements cannot be completely removed with the use of software in a control mechanism 15 (see FIG. 5) belonging to the printing machine, because the order of magnitude of the apparent compass and/or register errors, i.e. the spread values, can be mistaken for ordinary compass and/or register errors.

Figure 3:
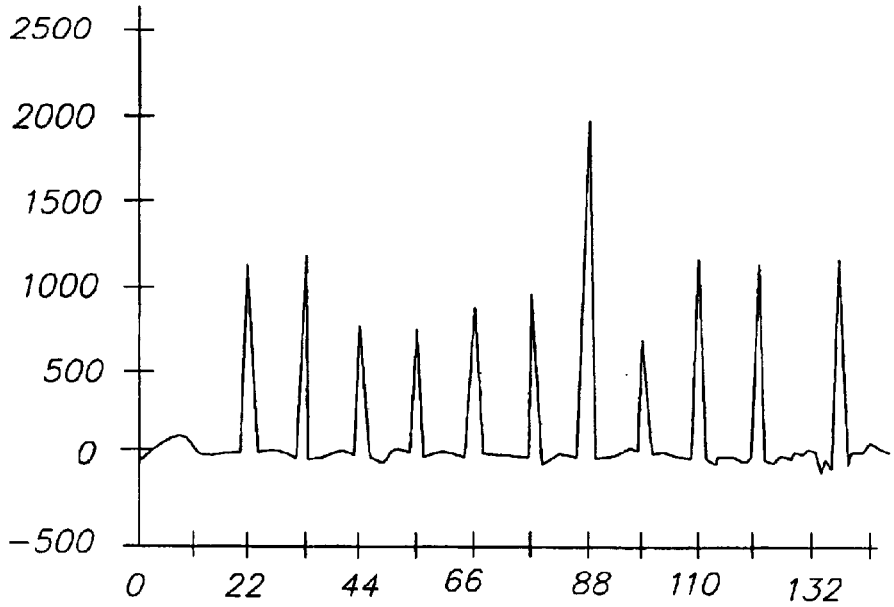
FIG. 3 shows a graph of register errors as function of patterns of mark at three printing colors, in relation to a black printing color.

FIG. 3 shows a graph similar to that shown in FIG. 2, where on the y-axis, compass and/or register errors are shown, in relation to the black printing color. The mark 12 of the black color is used here as the reference for the marks 12 of the other colors. On the x-axis, the numbers of patterns 13 are shown, from zero to approximately one hundred forty. Similar to FIG. 2, it can be seen that at every eleventh pattern 13 of marks 12, an obvious spread in measurement values occurs. The compass and/or register errors at every eleventh measuring value of each color falls essentially in the range of 750 micrometers to 1200 micrometers, while the compass and/or register errors in the case of the remaining patterns 13 of marks 12 vary around the zero point and show spreads only in the range of about −100 micrometers to +100 micrometers.

Figure 4:
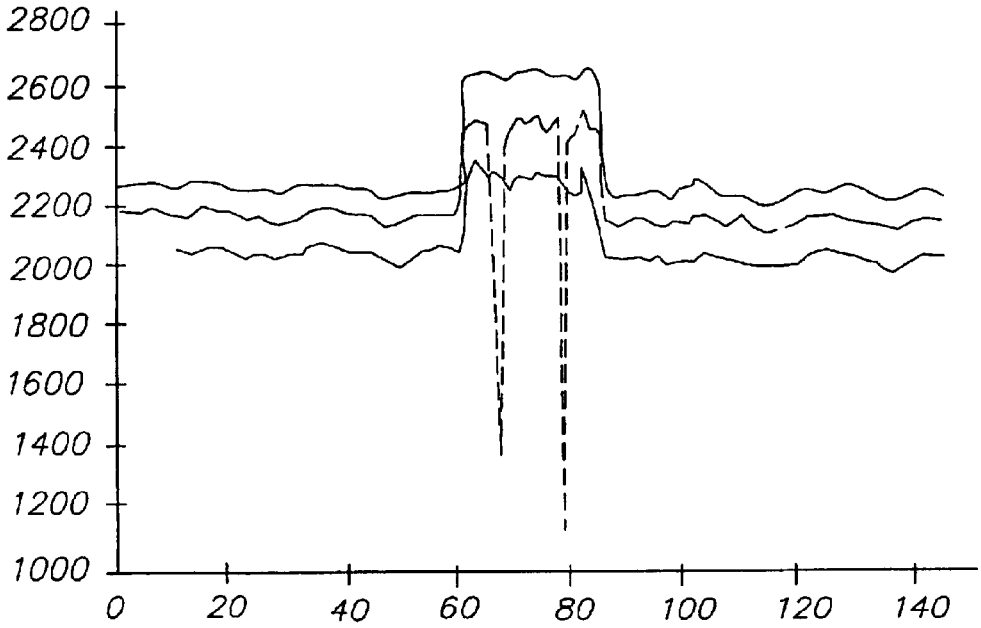
FIG. 4 shows a graph of corrected positions of compasses and/or registers as a function of patterns of marks at three printing colors.

FIG. 4 shows a graph of values for the corrected positions of the compasses and/or registers based on the graphs shown in FIGS. 2 and 3, as a function of the patterns 13 of marks 12 that are imprinted in three colors onto the carrying element 1. The values for the fourth color are similar. The values of the corrected positions of the compasses and/or registers are obtained when the compass and/or register error is measured and evaluated on the basis of the measurements of the corresponding error in the direction of travel. From these the corrected values, correction parameters are derived and the printing machine is calibrated so that the number of compass and/or register errors is reduced during the subsequent printing process. The correction parameters are referenced, for example, by the moment of imaging at which the colored partial pictures are transferred from the print mechanisms 4 to the imaging cylinder 3.

Provisions can also be made for the use of additional correction parameters for the correction of compass and/or register errors, such as a change in the speed of travel of the carrying element 1, or the imaging cylinder 3 and the intermediate cylinder 6. Using the aforementioned measures, adjustments can be made to the points at which during calibration the image is imprinted onto the carrying element 1 and during the printing process onto the printing medium. The individual colors are shown through various geometrical symbols, the color yellow by rhombuses, the color magenta by triangles, and the color cyan by squares.

The x-axis shows approximately one hundred-fifty patterns 13 with marks 12. It is clear that the positions of the compasses and/or the registers for the color yellow, varies across a range of approximately 2000 $\mu$m. The positions for the color magenta vary across a range of approximately 2200 $\mu$m, and for the color cyan vary across a range of approximately 2300 $\mu$m.

The fact that in the range of numbers from sixty to eighty-five the correction values of the patterns 13 deviate significantly from the remaining correction values is noteworthy. These inaccurate values arise from the fact that a computing mechanism 16 (see FIG. 5) that is incorporated in the control mechanism 15 gives spreads such as those shown in FIGS. 2 and 3, the same ordinary values that identify routine compass and/or register errors and that vary only moderately in the graphs shown by all of the figures. However, the spreads consist of values that are detected in the area of the seam 11. Particularly notable are spreads of marks 12 that are imprinted directly on the seam 11 of the carrying element 1. They fall in the range of approximately 1100 $\mu$m to 1300 $\mu$m and differ from the remaining values by approximately 700 $\mu$m to 900 $\mu$m, as seen in FIG. 4, whereby after increments of eleven patterns 13, two downward spreads for each color occur. In this case the inaccurate measurements in the area of pattern numbers ranging from approximately sixty to approximately ninety result in inaccurate correction parameters during the printing machine's calibration run.

Inaccurate correction values during calibration should usually be viewed more critically than correction values of individual faulty measurements arising during a printing job, because the correction values arising during calibration are usually used over a longer period of time and thus cause more damage with respect to compass and/or register errors.

FIG. 5 shows a basic model of an embodiment of the invention using a schematic overhead view of a section of a carrying element 1 that is designed to be a continuous loop and has a seam 11 where the carrying element 1 is welded together. A calibration run to adjust and calibrate the printing machine prior to imprinting printing media is depicted. Above the carrying element 1 and downstream of the printing modules, a first sensor 8 is secured, which detects marks 12 that are imprinted on the carrying element 1. The marks 12 are shaped like dashes and are grouped into a pattern 13 of marks 12. The figure shows four marks 12 for four respective colors, each from one print module. The marks 12 are each imprinted onto the carrying element 1 by one print module.

The first sensor 8 is connected to the computing mechanism 16. Mounted upstream of the print modules is a second sensor 7 that detects the seam and that is connected to the computing mechanism 16. Provision is also made for an angle of rotation sensor/transmitter 10 or web encoder, which is attached to a roller 9 (see FIG. 1) that has a drive shaft of the carrying element 1, and is connected to the computing mechanism 16.

For each rotation of the carrying element 1, the angle of rotation sensor/transmitter 10 emits 62500 pulses, which are counted. When the second sensor 7 detects the seam, the continuously increasing count on the angle of rotation sensor/transmitter 10 is read and stored. When at a certain point in time, the point at which the seam 11 is located is reported, the actual count of the angle of rotation sensor/transmitter 10 is read and from this, the count that was stored the last time the seam was detected is subtracted. The difference derived therefrom, a number of impulses, is simply converted into a unit of length whereby the distance between the seam 11 and the second sensor 7 is ascertained.

The printing of each mark 12, onto the carrying element 1, is triggered by an electronically generated pulse from the second sensor 7. In the course of the calibration process, the pulse mimics the leading edge of a sheet of paper during a printing operation, i.e., the leading edge is simulated. During the printing process the marks 12 are ideally imprinted onto the sheet of paper at a particular, known distance from the leading edge of the sheet of paper. When the pulse from the second sensor 7 is transmitted to the computing mechanism 16, for each print mechanism 4 that is used for imaging the imaging cylinder 3, clock pulses are counted off, in accordance with which the imaging cylinder 3 receives information. Therefore, the marks 12 are essentially imprinted at a known distance from the leading edge of the sheet of paper. In the course of the present calibration, the marks 12 are imprinted at the desired places on the carrying element 1. The first sensor 8 detects the marks 12 downstream from the print modules and transmits a pulse for each mark to the computing mechanism 16, in which set values are stored that identify the points in time at which the marks 12 are detected by sensor 8 when no compass and/or register errors exist. The set values are compared with the actual values measured by the sensor 8, whereby a compass and/or register error is identified for each color corresponding to each mark 12. This is the deviation of the actual value from the set value in the form of a unit of time that characterizes the distance of a mark 12 between an error-free position and an incorrect position of such a mark 12. In this case, it is a deviation in the direction of travel.

As described above and depicted in FIGS. 2 through 4, the calculated compass and/or register error becomes skewed by the presence of the seam 11. The result is measurement errors amounting to several hundred micrometers. Consequently, the correction parameters assigned from the calculated compass and/or register errors are incorrectly identified by the control mechanism 15, i.e., the adjustment mechanism used for adjusting print parameters by correction parameters during the calibration of the printing machine is distorted.

By detecting the seam 11 with the second sensor 7 working together with the angle of rotation sensor/transmitter 10, which ascertains the position of the carrying element 1 by counting off pulses, the position of the seam 11 on the carrying element 1 becomes known. If the seam is in a certain area around a detection point of the first sensor 8 where the first sensor 8 detects the marks 12, then the sensor values of the first sensor 8, transmitted to the computing mechanism 16 upon detection of the marks 12, are not used for calculating a compass and/or register error. Rather, these sensor values are discarded.

The area in which the sensor values of the first sensor 8 are discarded is defined in FIG. 5 by the length d. The length d may be freely selected, but is preferably 37 mm, in particular, 25.6 mm, i.e., 18.5 mm or 12.8 mm in front of and behind the point of detection. A faulty measurement based upon the seam 11 is precluded when the distance between the seam 11 and the second sensor 7 is greater than the distance between the first sensor 8 and the second sensor 7. In such a case the seam 11 is not within the range of measurement of the first sensor 8.

The distance between the seam 11 and the second sensor 7 can be calculated in the computing mechanism 16 from a sensor signal generated when the second sensor 7 detects the seam 11 and from the knowledge of the number of clock pulses per unit of length coming from the angle of rotation sensor/transmitters 10. This distance is calculated from the number of clock pulses counted by the angle of rotation sensor/transmitter 10 since the last detection of the seam 11. When the distance between the seam 11 and the second sensor 7 is smaller than the distance between the first sensor 8 and the second sensor 7, the seam 11 is moving toward the first sensor 7. In such a case it is possible that an inaccurate measurement will result.

In an alternative to the above embodiment, only those sensor values coming from the second sensor 7 are discarded, which come from the detection of the seam 11. In this case, not all of the sensor values that are located within the distance d, are discarded. This case assumes that the first sensor 8 and the control mechanism downstream from the print modules are capable of distinguishing between the seam 11 and the marks 12. In the prescribed manner, spread values based upon the seam 11 are discarded, the correction parameters for adjusting the printing machine parameters during the calibration run are significantly improved, and ultimately, the compass and/or register errors during the printing process are more successfully avoided.

The invention has been described in detail with particular reference to certain preferred embodiments thereof, but it will be understood that variation and modifications can be effected within the spirit and scope of the invention.

What is claimed is:

1. A process for avoiding compass and/or register errors in a printing machine, comprising the steps of: imprinting marks (12) on a carrying element (1); detecting the marks (12) on the carrying element (1) with a first sensor (8), detecting a seam (11) on the carrying element (1) with a second sensor (7); and discarding detected sensor values read by the first sensor (8) in the area of the seam (11), that is detected by the second sensor (7), wherein the area in which the sensor values read by the first sensor (8) are discarded, is 18.5 mm long upstream of the seam (11) and 18.5 mm long downstream of the seam (11), in relation to the direction of travel of the carrying element (1).

2. A process according to claim 1, wherein an angle of rotation ascertains the rotation of the carrying element (1), by a sensor/transmitter (10) on a drive shaft of the carrying element (1); upon detecting the seam (11), the second sensor (7) transmits a sensor signal to a control mechanism (15), and the control mechanism (15) reads the count value of the angle of rotation sensor/transmitter (10); and, based on the count value, identifying the location of the seam (11) on the carrying element (1).

3. A process according to claim 2, wherein the sensor values read by the first sensor (8) in the area of the seam (11) that is detected by second sensor (7) are stored in the control mechanism (15), are then compared with compass and/or register errors of a printing machine, and on the basis of the comparison, a determination is made as to whether the sensor values are to be discarded.

4. A process according to claim 3, wherein only those sensor values read by the second sensor (7) are discarded that arise from the detection of the seam (11) by the second sensor (7).

5. A process according to claim 4, wherein the sensor values read by the first sensor (8) are examined in the control mechanism (15) and as a result of the examination, those sensor values of the first sensor (7) are discarded which come about from the detection of the seam (11) by the second sensor (7).

6. A process for avoiding compass and/or resister errors in a printing machine, comprising the steps of: imprinting marks (12) on a carrying element (1); detecting the marks (12) on the carrying element (1) with a first sensor (8), detecting a seam (11) on the carrying element (1) with a second sensor (7); and discarding detected sensor values read by the first sensor (8) in the area of the seam (11), that is detected by the second sensor (7), wherein the area in which the sensor values read by the first sensor (8) are discarded is 12.8 mm long upstream of the seam (11) and 12.8 mm long downstream of the seam (11), in relation to the direction of travel of the carrying element (1).

7. A control mechanism of a printing machine, including a closed loop image carrying element, for avoiding register errors, comprising:

at least one first sensor (8) for detecting marks (12) on the carrying element (1);

a second sensor (7) for detecting a seam (11) on the carrying element (1) and a device for receiving mark values from said first sensor seam values from said second sensor, and discarding mark values when said seam is detected, wherein the area in which the sensor values read by the first sensor (8) are discarded, is 18.5 mm long upstream of the seam (11) and 18.5 mm long downstream of the seam (11), in relation to the direction of travel of the carrying element (1).

8. A control mechanism of a printing machine, including a closed loop image carrying element, for avoiding register errors, comprising:

at least one first sensor (8) for detecting marks (12) on the carrying element (1);

a second sensor (7) for detecting a seam (11) on the carrying element (1) and a device for receiving mark values from said first sensor seam values from said second sensor, and discarding mark values when said seam is detected, wherein the area in which the sensor values read by the first sensor (8) are discarded is 12.8 mm long upstream of the seam (11) and 12.8 mm long downstream of the seam (11), in relation to the direction of travel of the carrying element (1).

* * * * *